US012698072B1

(12) United States Patent
Holda

(10) Patent No.: US 12,698,072 B1
(45) Date of Patent: Aug. 4, 2026

(54) OUTBOARD MOTORS AND COOLING SYSTEMS FOR OUTBOARD MOTORS

(71) Applicant: Brunswick Corporation, Mettawa, IL (US)

(72) Inventor: Joseph A. Holda, West Bend, WI (US)

(73) Assignee: Brunswick Corporation, Mettawa, IL (US)

( * ) Notice: Subject to any disclaimer, the term of this patent is extended or adjusted under 35 U.S.C. 154(b) by 319 days.

(21) Appl. No.: 18/404,424

(22) Filed: Jan. 4, 2024

(51) Int. Cl.
*B63H 20/28* (2006.01)
*B63H 20/10* (2006.01)
*B63H 20/32* (2006.01)

(52) U.S. Cl.
CPC ..... *B63H 20/285* (2013.01); *B63H 20/10* (2013.01); *B63H 20/32* (2013.01)

(58) Field of Classification Search
CPC ..... B63H 20/285; B63H 20/10; B63H 20/32
See application file for complete search history.

(56) References Cited

U.S. PATENT DOCUMENTS 4,548,257 A 10/1985 Williamson
11,691,707 B1 7/2023 Oenick
2007/0107424 A1 5/2007 Wizgall
2010/0084111 A1 4/2010 Jaeger
2011/0195620 A1* 8/2011 Davis ..... B63H 20/14 440/75
2014/0133098 A1 5/2014 Campbell
2018/0073810 A1 3/2018 Kimball
2019/0154345 A1 5/2019 Martinez
2023/0202636 A1* 6/2023 Hikosaka ..... B63H 20/285 440/77

OTHER PUBLICATIONS

Declaration of Prior Art by Joseph A. Holda dated Jan. 4, 2024.

* cited by examiner

*Primary Examiner* — Stephen P Avila
(74) *Attorney, Agent, or Firm* — Andrus Intellectual Property Law, LLP

(57) ABSTRACT

An outboard motor comprises a first cooling system comprising a first pump configured to circulate the first cooling fluid through the outboard motor and a second cooling system comprising a reservoir configured to contain a second cooling fluid and a second pump configured to pump the second cooling fluid to at least one component of the outboard motor. A heat exchanger is configured to exchange heat between the first cooling fluid and the second cooling fluid to cool the at least one component of the outboard motor. The second pump is located longitudinally forwardly of the reservoir and axially below the reservoir.

20 Claims, 11 Drawing Sheets

OUTBOARD MOTORS AND COOLING SYSTEMS FOR OUTBOARD MOTORS

FIELD

The present disclosure relates to outboard motors, cooling systems for outboard motors, combination reservoir and heat exchanger apparatuses and related cooling systems for marine drives including but not limited to outboard motors.

BACKGROUND

U.S. Pat. No. 11,691,707 is incorporated herein by reference and discloses a system for draining a cooling system of a power generation system on a marine vessel that includes a pump in fluid communication with the cooling system, the pump actively removing cooling water from the cooling system. An outlet drain discharges the cooling water. A controller starts the pump in response to an operator command to stop a prime mover of the marine power generation system and/or a speed of the prime mover being below a threshold speed.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a first cooling system comprising a first pump configured to circulate the first cooling fluid through the outboard motor and a second cooling system comprising a reservoir configured to contain a second cooling fluid and a second pump configured to pump the second cooling fluid to at least one component of the outboard motor. A heat exchanger is configured to exchange heat between the first cooling fluid and the second cooling fluid to cool the at least one component of the outboard motor. The second pump is located longitudinally forwardly of the reservoir and axially below the reservoir.

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a powerhead and a top cowl enclosing the powerhead in a powerhead compartment. The top cowl can be opened or removed from the outboard motor to provide access to the powerhead from above the outboard motor. A first cooling system comprises a first pump configured to circulate the first cooling fluid through the outboard motor, and a second cooling system comprises a reservoir configured to contain a second cooling fluid and a second pump configured to pump the second cooling fluid to cool at least one component of the outboard motor. A heat exchanger is configured to exchange heat between the first cooling fluid and the second cooling fluid to cool the at least one component of the outboard motor. The second pump and first pump are accessible from above the outboard motor upon opening and/or removal of the top cowl.

In independent examples, an apparatus on a marine drive having a first cooling system configured to convey a first cooling fluid through the marine drive and a second cooling system configured to convey a second cooling fluid through the marine drive comprises a reservoir configured to store the second cooling fluid and a heat exchanger configured to exchange heat between the first cooling fluid and the second cooling fluid. The reservoir and the heat exchanger are integrated as a single part.

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a first cooling system configured to convey a first cooling fluid through the outboard motor and a second cooling system configured to convey a second cooling fluid through the outboard motor. An apparatus for the second cooling system comprising a reservoir configured to store the second cooling fluid, and a heat exchanger configured to exchange heat between the first cooling fluid and the second cooling fluid. The reservoir and the heat exchanger are integrated as a single part.

Various other features, objects, and advantages will be made apparent from the following description taken together with the drawings.

BRIEF DESCRIPTION OF THE DRAWINGS

The present disclosure is described with reference to the following drawings.

DETAILED DISCLOSURE

Figure 1:
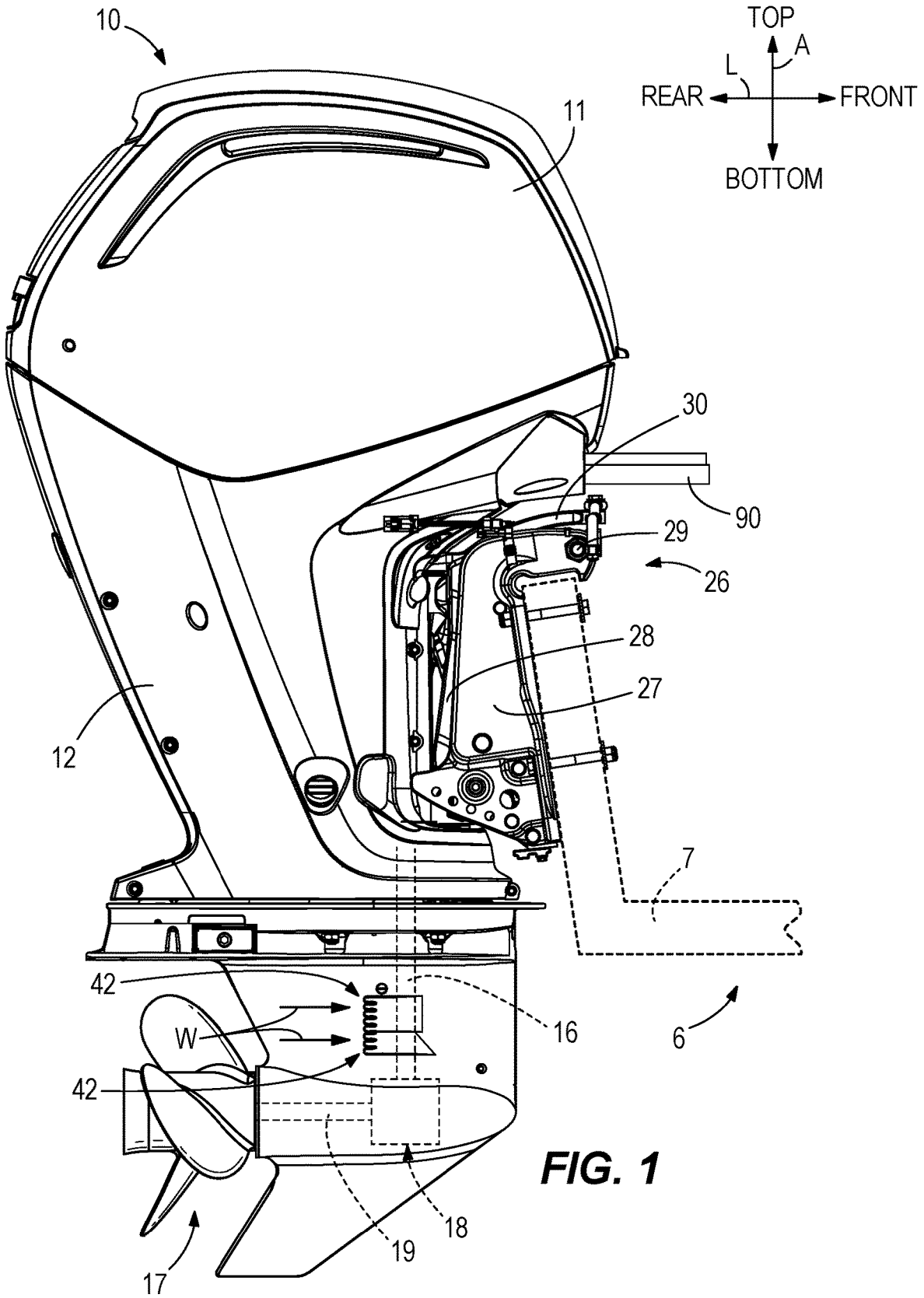
FIG. 1 is a side view of an example marine drive according to the present disclosure
Figure 2:
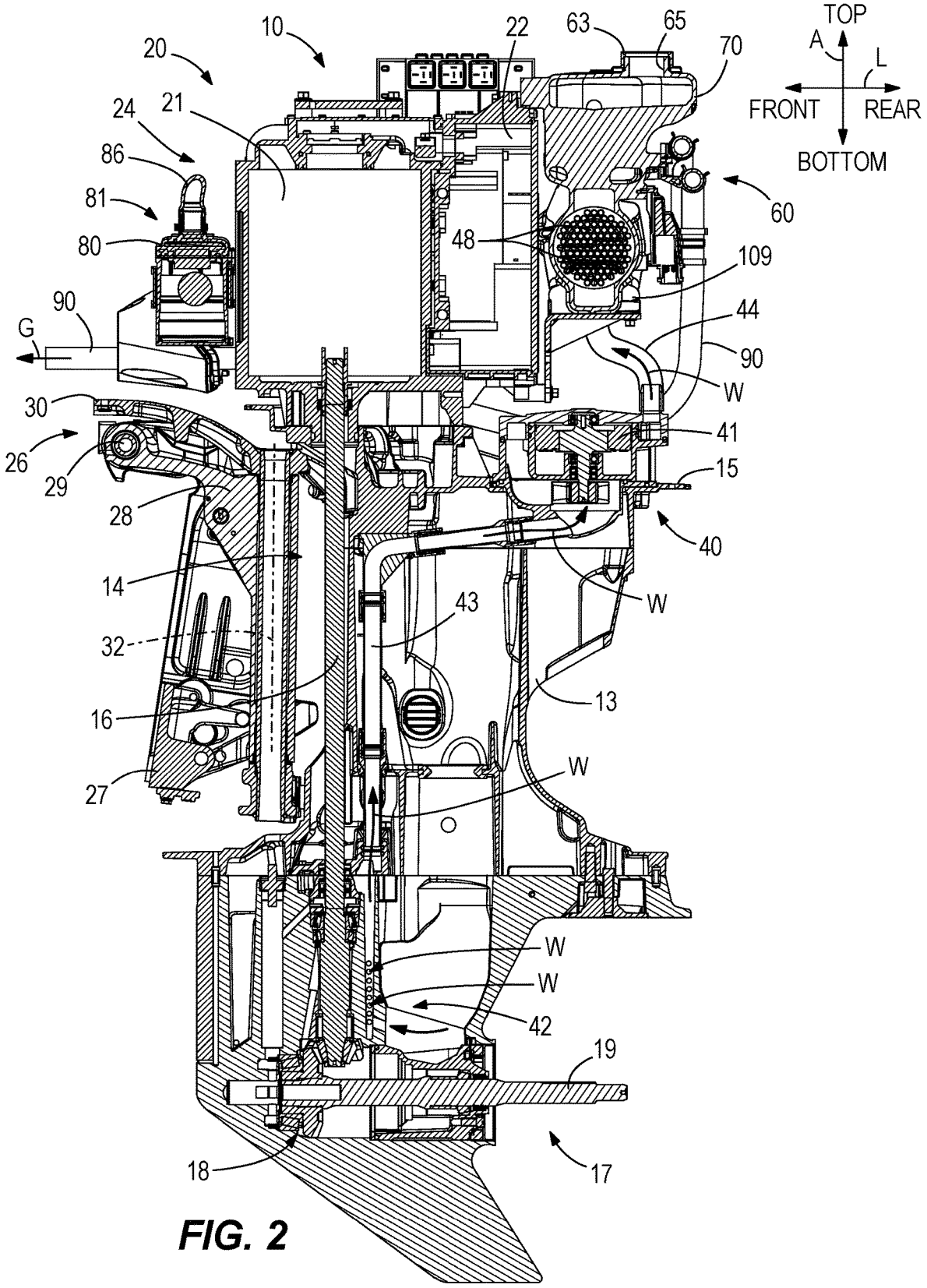
FIG. 2 is a cross-sectional view of the marine drive of FIG. 1 with the cowls removed.

FIGS. 1-2 depict a marine drive 10 for propelling a marine vessel 6 in water. The example marine drive 10 illustrated in FIGS. 1-2 is an outboard motor with a top cowl 11 and a lower cowl 12 that covers a midsection 13 (FIG. 2). The illustrated type of marine drive is not necessarily limiting and in many respects the present disclosure is also applicable to other types of marine drives, such as stern drives, pod drives, and/or the like. In the illustrated example, the midsection 13 has a driveshaft housing 14 suspended from an adapter plate 15. The driveshaft housing 14 houses the driveshaft 16 and other usual components of an outboard motor, such as exhaust components, cooling systems components, electrical components, and/or the like. Note that various other components normally associated with outboard motors may also be provided with or coupled to the midsection 13. The marine drive 10 extends from a top to a bottom in an axial direction (see example axis A), from a port side to a starboard side in a lateral direction (see example T axis on FIGS. 3-4) which is perpendicular to the axial direction, and from a front side to a rear side in a longitudinal direction (see example L axis) which is perpendicular to the axial direction and perpendicular to the lateral direction.

A conventional transom bracket assembly 26 is configured to mount the marine drive 10 on the marine vessel 6. The transom bracket assembly 26 includes a transom bracket 27 which is fixed to the transom 7 on the marine vessel 6 and a swivel bracket 28 which is pivotably coupled to the transom bracket 27. The swivel bracket 28 is also coupled to the midsection 13 for example via fasteners and/or one or more shock-absorbing mounts, as is known in the art. One or more trim actuators (not depicted; e.g., hydraulic cylinders) are provided for trimming the marine drive 10 about a trim axis 29 relative to the transom bracket assembly 26. Specifically, the trim actuators are configured pivot the swivel bracket 28 about the trim axis 29 and thus the marine drive 10 is pivoted relative to the transom 7 of the marine vessel 6.

Referring to FIG. 2, a steering arm 30 extends from the midsection 13 and is configured to be pivoted upon actuation of a steering actuator (not depicted) which is configured to steer the marine drive 10 about a steering axis 32 (FIG. 2).

A powerhead 20, such as a gas engine and/or an electric motor, is coupled to the adapter plate 15. The depicted powerhead 20 includes an electric motor 21 configured to rotate the driveshaft 16. An inverter 22 is configured to provide electrical power to the motor 21. The inverter 22 receives the electrical power from a power supply (e.g., rechargeable batteries on the marine vessel 6) via an electrical cable (not depicted). The top cowl 11 encloses the powerhead 20 in a powerhead compartment 24 located above the adapter plate 15. The top cowl 11 can be opened or removed from the marine drive 10 to provide access to the powerhead compartment 24 and the powerhead 20 from above the marine drive 10.

A propulsor 17 (e.g., one or more propellers, impellers, and/or the like) is positioned at the bottom of the driveshaft housing 14 and is coupled to the driveshaft 16 via a gearset 18 (e.g., a beveled gearset assembly). In operation, the rotation of the driveshaft 16 causes the gearset 18 and a propulsor shaft 19 to rotate such that the propulsor propels the marine vessel 6 in the water.

The motor 21, the inverter 22, and other components of the marine drive 10 are cooled by one or more cooling systems 40, 60, which are described in more detail herein below.

Referring to FIG. 2, one of the cooling systems is an open loop, first cooling system 40. This system 40 has a first pump 41 configured to circulate a first cooling fluid through the marine drive 10. The first cooling fluid can be any suitable fluid, and in the example depicted in FIGS. 1-2, the first cooling fluid is water from the body of water in which the marine vessel 6 and the marine drive 10 are located.

The first pump 41 draws the first cooling fluid (see arrows W) from the relatively lower temperature water in the body of the water via one or more water inlets 42 in the lower cowl 12 (see also FIG. 1). A first water inlet conduit 43 extends between the water inlets 42 and the first pump 41. The first pump 41 then pumps the first cooling fluid through a second water inlet conduit 44 and further through conduits 48 (FIG. 7) in a heat exchanger 109 (described in greater detail herein below). The conduits 48 define first passages 124 (FIG. 7) which extend through the heat exchanger 109. The first cooling fluid absorbs heat/thermal energy from the second cooling fluid, which is also in the heat exchanger 109 (note that the first cooling fluid is fluidly separated from the second cooling fluid) via the conduits 48. As such, the temperature of the first cooling fluid exiting the heat exchanger 109 is relatively higher than the temperature of the first cooling fluid entering the heat exchanger 109.

After exiting the heat exchanger 109, the first cooling fluid passes through one or more conduits (not depicted) and/or the adapter plate 15 (FIG. 2) and flows back into the body of water. In certain examples, the relatively higher temperature first cooling fluid (e.g., water) exits the marine drive 10 via the propulsor 17 (e.g., the propeller hub). Note that in certain examples, the first pump 41, the conduits 43, 48, and/or the heat exchanger 109 define an open loop, first cooling circuit.

Note that the first pump 41 is accessible for servicing from above marine drive 10 via opening or removing the top cowl 11 (FIG. 2), and that the first pump 41 and/or heat exchanger 109 is located in the powerhead compartment 24 (FIG. 1). In certain examples, the first pump 41 is located on or above the adapter plate 15. Further note that the first cooling fluid can fully drain from the first cooling system 40 regardless of the position (tilt/trim/steer) of the marine drive 10.

Figure 3:
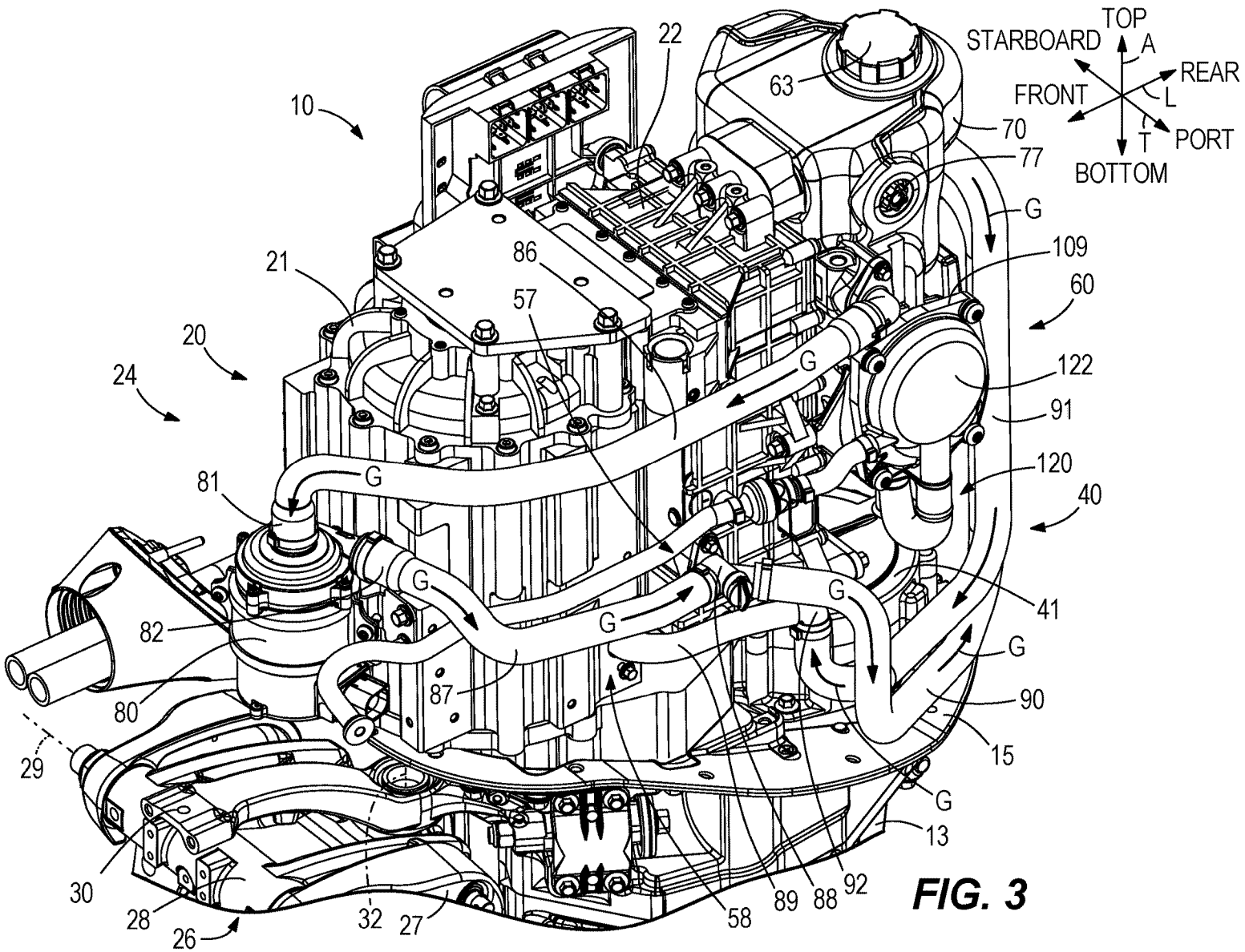
FIGS. 3-4 are perspective views of the internal components of the marine drive of FIG. 1.
Figure 4:
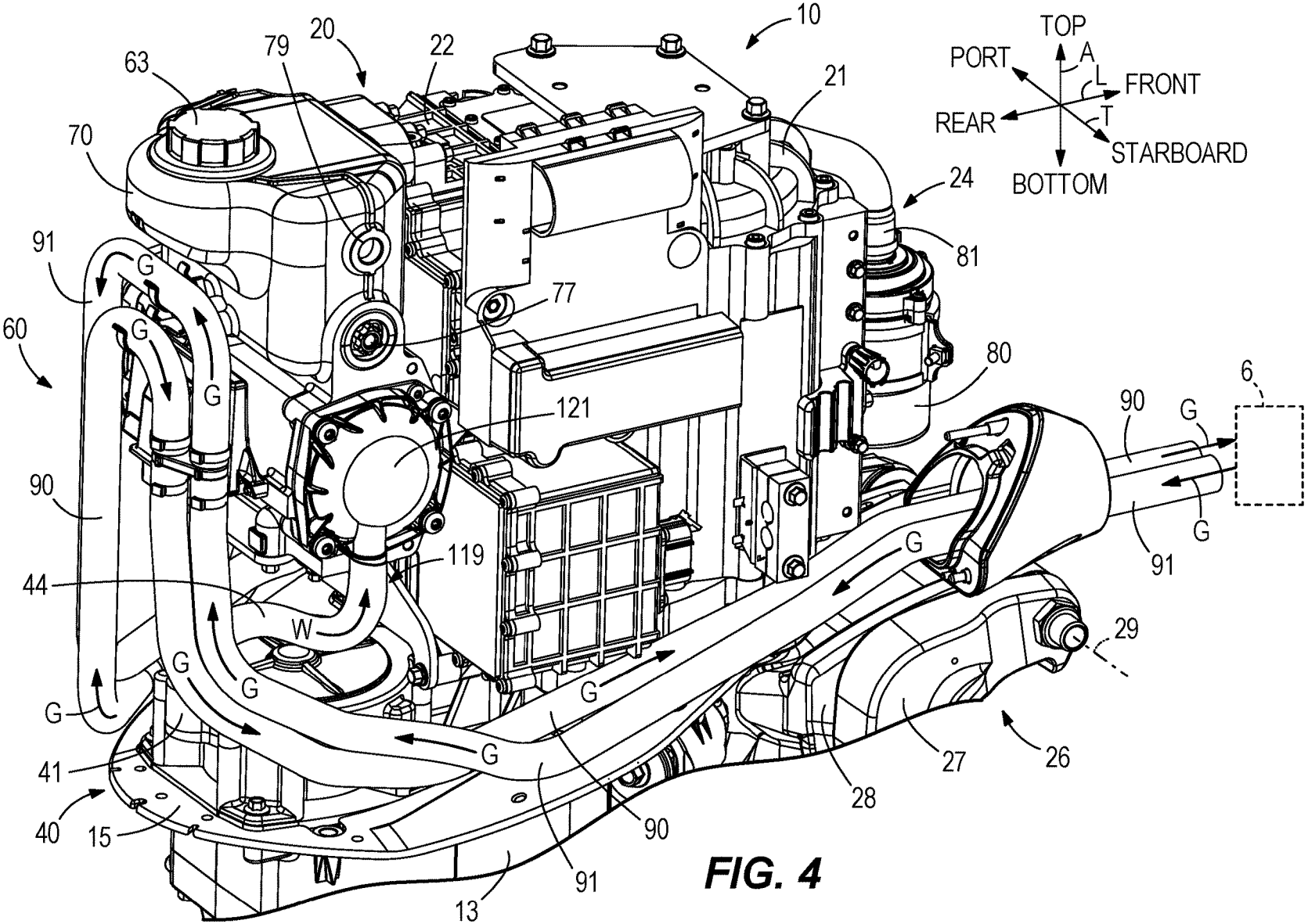
Figure 5:
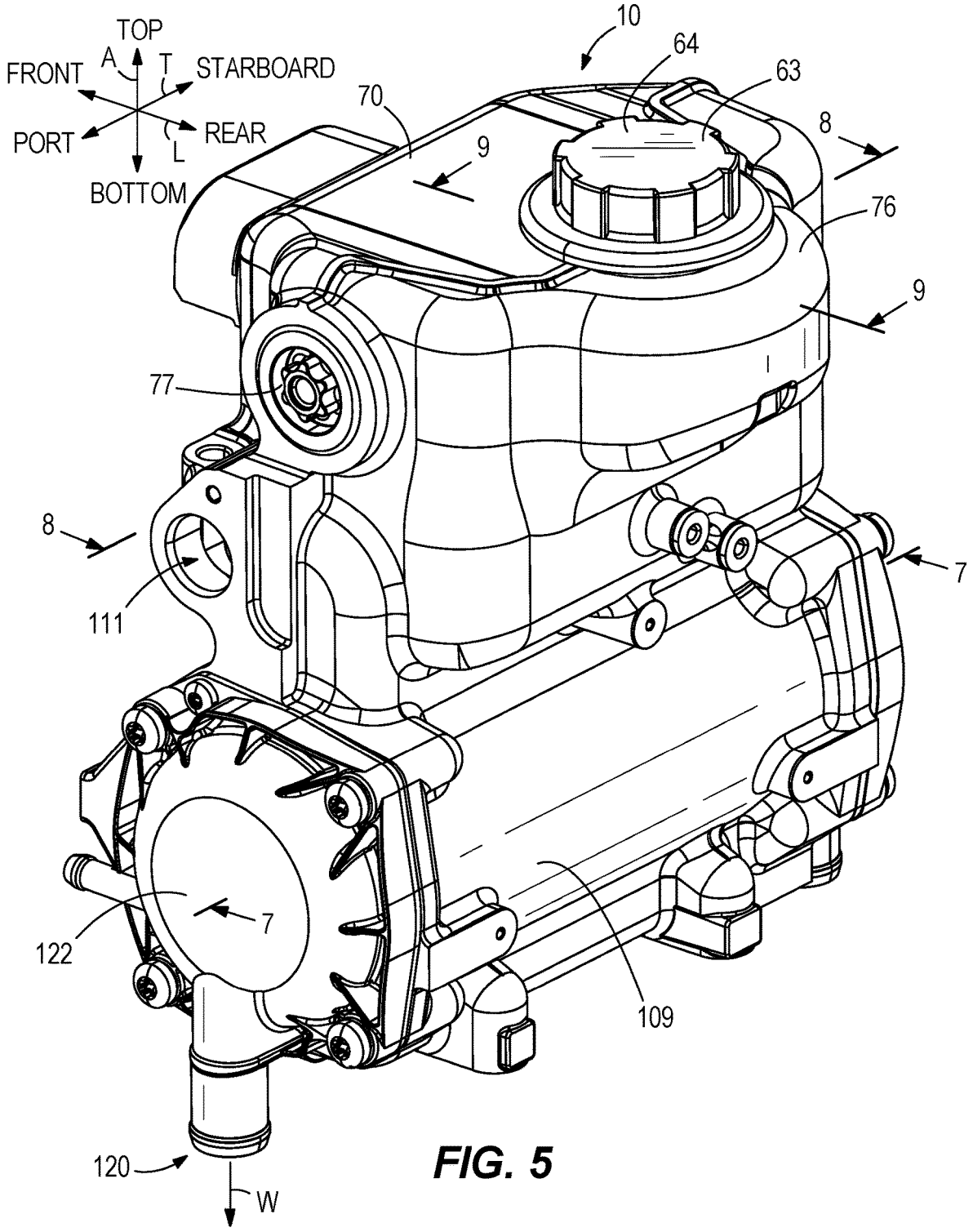
FIG. 5 is a perspective view of an example combination heat exchanger and reservoir apparatus according to the present disclosure.
Figure 6:
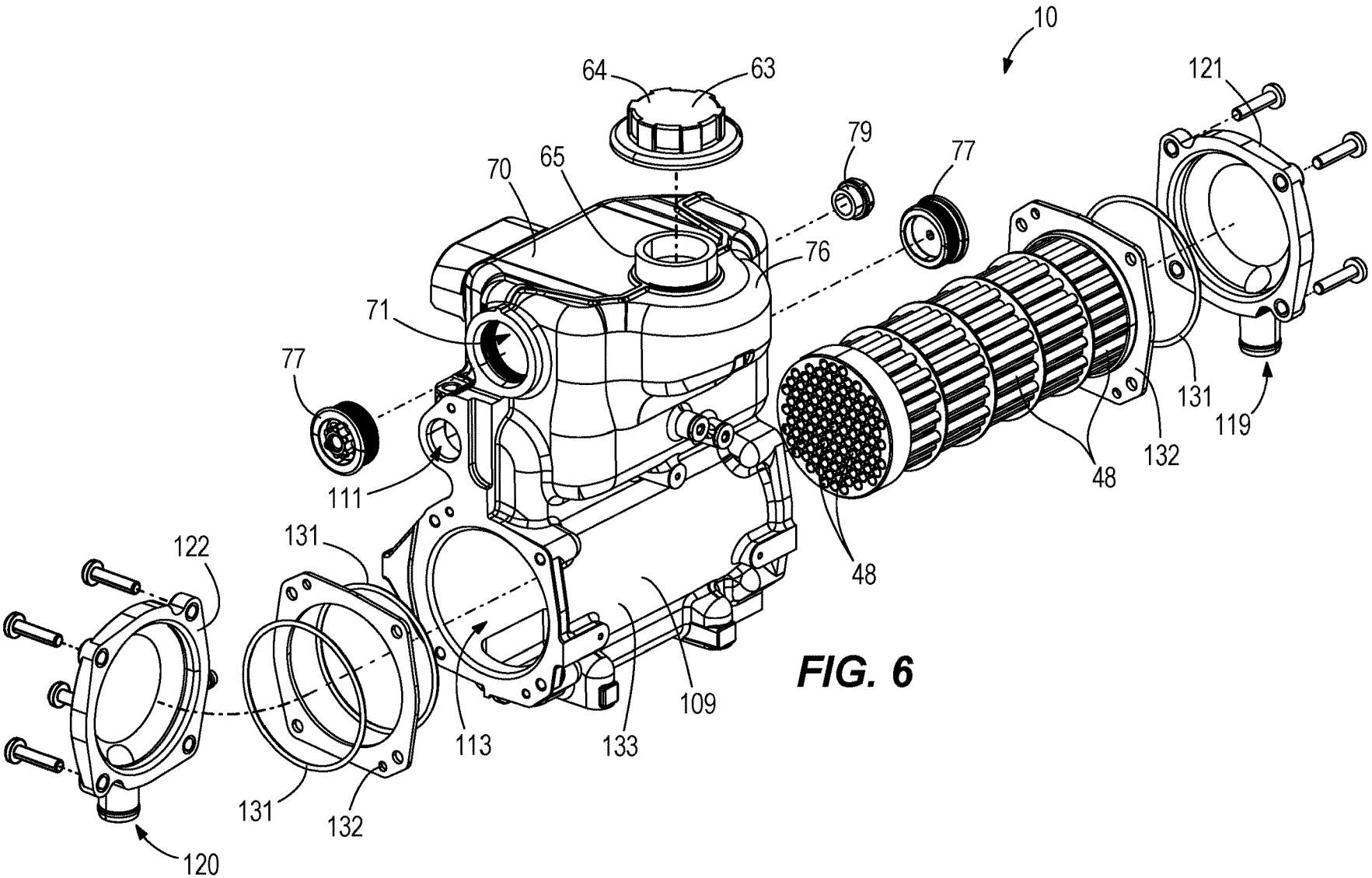
FIG. 6 is an exploded view of the apparatus of FIG. 5.

Turning now to FIGS. 3-4, the marine drive 10 also includes a closed loop, second cooling system 60 having a reservoir 70 that contains the second cooling fluid and a second pump 80 configured to pump the second cooling fluid through the heat exchanger 109. The second pump 80 is located longitudinally between the transom bracket 27 (FIG. 2) and the reservoir 70, and the second pump 80 is accessible for servicing from above marine drive 10 via opening or removing the top cowl 11 (FIG. 2).

A pump inlet 81 receives the second cooling fluid passing through a first inlet conduit 86 which is coupled to a second outlet 111 (FIG. 7) of the heat exchanger 109. The pump inlet 81 is oriented upwardly in the axial direction to prevent damage to the seal therein which may occur if air accumulates in the top of the second pump 80.

The second pump 80 pumps the second cooling fluid via a pump outlet 82 to a first outlet conduit 87 (FIG. 3) which is coupled to conduit connector 88 (e.g., y-shaped). The conduit connector 88 is configured to direct the second cooling fluid through an inverter inlet 57 into the inverter 22 and/or the motor 21. The second cooling fluid directed through the inverter inlet 57 passes through internal channels (not depicted) in the inverter 22 and/or the motor 21 such that thermal energy from the inverter 22 and/or the motor 21 transfers to the second cooling fluid. The warmed second cooling fluid exits the motor 21 via a motor outlet 58 (FIG. 3) to a second outlet conduit 89 (FIG. 3).

The conduit connector 88 noted above is also configured to direct the second cooling fluid through a third outlet conduit 90. The third outlet conduit 90 extends around the port side, the rear side, and the starboard side of the marine drive 10 and further away from the marine drive 10 into the marine vessel 6 (see FIG. 1). The second cooling fluid pumped through the third outlet conduit 90 is supplied to a battery or other components on the marine vessel 6 to thereby cool these components (e.g., these components transfer thermal energy to the second cooling fluid). The warmed, second cooling fluid returns to the marine drive 10 via a fourth outlet conduit 91 that also extends around the port side, the rear side, and the starboard side of the marine drive 10.

Note on FIG. 4 that the third outlet conduit and the fourth outlet conduit both include an upwardly extending bend oriented in a direction away from the first pump 41 such that the first pump 41 is accessible for servicing and replacement. In addition, the reservoir 70 is axially above the first pump 41 (the first pump 41 also being located longitudinally rearwardly of the reservoir 70) to increase accessibility and serviceability of the first pump 41. In certain examples, the first pump 41 is located axially lower than the second pump 80 and/or longitudinally rearwardly of the electric motor 21 to increase accessibility and serviceability of the first pump 41. In certain examples, the second pump 80 is located closer to the port side than the starboard side of the marine drive 10. In certain examples, it is advantageous to position several of the conduits and/or the pump outlet 82 on the port side of the marine drive (see for example FIG. 3) and further position the rigging elbow through which the third outlet conduit 90 and the fourth outlet conduit 91 extend on the starboard side of the marine drive 10 so that rigging electrical connections is easily completed on the starboard side.

The second cooling fluid from the second outlet conduit 89 and the fourth outlet conduit 91 pass to another conduit connector 92. The conduit connector 92 is configured to direct the second cooling fluid from the second outlet conduit 89 and the fourth outlet conduit 91 to a second inlet conduit (not depicted for clarity). The second inlet conduit is coupled to and directs the warmed second cooling fluid to the second inlet 112 (FIG. 7) of the heat exchanger 109. The heat exchanger 109 facilitates heat transfer from the second cooling fluid to the first cooling fluid. FIGS. 5-9 depict an example heat exchanger 109 in more detail.

The first cooling fluid enters the heat exchanger 109 via a first inlet 119 which is defined in a first end cap 121 of the heat exchanger 109. The heat exchanger 109 also includes a second end cap 122 with a first outlet 120 defined therein through which the first cooling fluid exits the heat exchanger 109. In certain examples, one or more gaskets 131 and/or brackets 132 (see FIG. 6) are sandwiched between a body 133 of the heat exchanger 109 and the end caps 121, 122.

The second cooling fluid enters the heat exchanger 109 via the second inlet 112 and passes through a chamber 113 defined by the heat exchanger 109. One or more baffles 114 extend in the chamber 113 and generally define one or more second passages 125 along which the second cooling fluid passes. In the example depicted in FIG. 7, the baffles 114 define an exemplary second passage 125 along which the second cooling fluid generally passes by the conduits 48, e.g., the second cooling fluid passes the conduits five times (see arrow G on FIG. 7).

As noted above, the heat exchanger is configured to facilitate the transfer of thermal energy from the warmed second cooling fluid to the relatively cooler first cooling fluid. Specifically, passing the second cooling fluid through the heat exchanger 109 causes thermal energy to transfer from the second cooling fluid to the conduits 48 extending therethrough and further to the first cooling fluid passing through the conduits 48. As such, the temperature of the second cooling fluid exiting the chamber 113 is relatively cooler than the temperature of the second cooling fluid entering the chamber 113.

The second cooling fluid exits the chamber 113 via an outlet passageway 116. In certain examples, the outlet passageway 116 is integrally formed with the reservoir 70 and the heat exchanger 109 thereby advantageously eliminating connection components (e.g., a y-tube) that are used to fluidly connect conventional reservoirs and heat exchangers.

The second cooling fluid exits the outlet passageway 116 and the heat exchanger 109 via the second outlet 111 which is connected to the first inlet conduit 86 (see FIG. 3). The second cooling fluid then again passes through the first inlet conduit 86 to the second pump 80, and the second pump 80 is configured to recirculate the second cooling fluid along the path and/or through the components described above. Note that in certain examples, the second pump 80, the conduits 86, 87, 89, 90, 91, the conduit connectors 88, 92, and/or the heat exchanger 109 define a closed loop, second cooling circuit.

In certain examples, the reservoir 70 and/or the heat exchanger 109 are located such that the first outlet 120 and the second outlet 111 remain below a fluid level of the second cooling fluid in the reservoir 70 throughout the range of trim positions (described further hereinbelow). Note in other examples the first outlet 120 is not below the fluid level of the second cooling fluid in the reservoir 70 throughout the range of trim positions. In certain examples, the marine drive 10 includes a propulsor (not depicted) which can be advantageously cooled by the second cooling system 60 when the propulsor 17 is in a trim position for trickle charge and over temp conditions. In these examples, the second cooling system 60 acts as a heat sink for low power dissipation.

Still referring to FIGS. 5-9, the reservoir 70 is described in greater detail herein below. The reservoir 70 is coupled to the heat exchanger 109. In certain examples, the reservoir 70 and the heat exchanger 109 are integrally formed with each other and/or are integrated together as a single part. In one specific example, the single part is a monolithic body comprising the reservoir 70 and the heat exchanger 109. In certain examples, the single part is a cast metal part. In other examples, the single part extends from a port first side to a starboard second side in the lateral direction T and from top to bottom in the axial direction A which is perpendicular to the lateral direction T and the reservoir 70 is located axially higher than the heat exchanger 109. Note that in other examples, the reservoir 70 and the heat exchanger 109 are spaced apart from each other and/or coupled to each other by conduits (not depicted). Also note that the combination reservoir 70 and heat exchanger 109 can be collectively referred to as an apparatus herein. The present inventors recognized that integrating the reservoir 70 and the heat exchanger 109 together as a single apparatus or part advantageously eliminates connection components otherwise necessary to fluidly couple conventional reservoirs to conventional heat exchangers and provides a greater number of structural mounting surfaces in comparison to conventional plastic reservoirs.

The reservoir 70 and the heat exchanger 109 share an internal wall 72, and the wall 72 separates the reservoir 70 from the heat exchanger 109. The wall 72 defines one or more air bleed holes 73 configured to bleed air from the chamber 113 and/or one of the second passages 125 to the reservoir 70. The present inventors recognized that air may collect in conventional heat exchangers and/or cooling systems and the accumulation of air could have negative effects on the heat exchangers and/or cooling systems such as decreased system efficiency and/or effectiveness and/or damage to components. Air may enter or be in the heat exchanger and/or cooling system during the initial filling of the heat exchanger with the second cooling fluid or due to leaks in the cooling system. As such, the present inventors designed the air bleed holes 73 of the present disclosure to advantageously provide a path through which air in the heat exchanger 109 passes to avoid excessive buildup of air.

Figure 7:
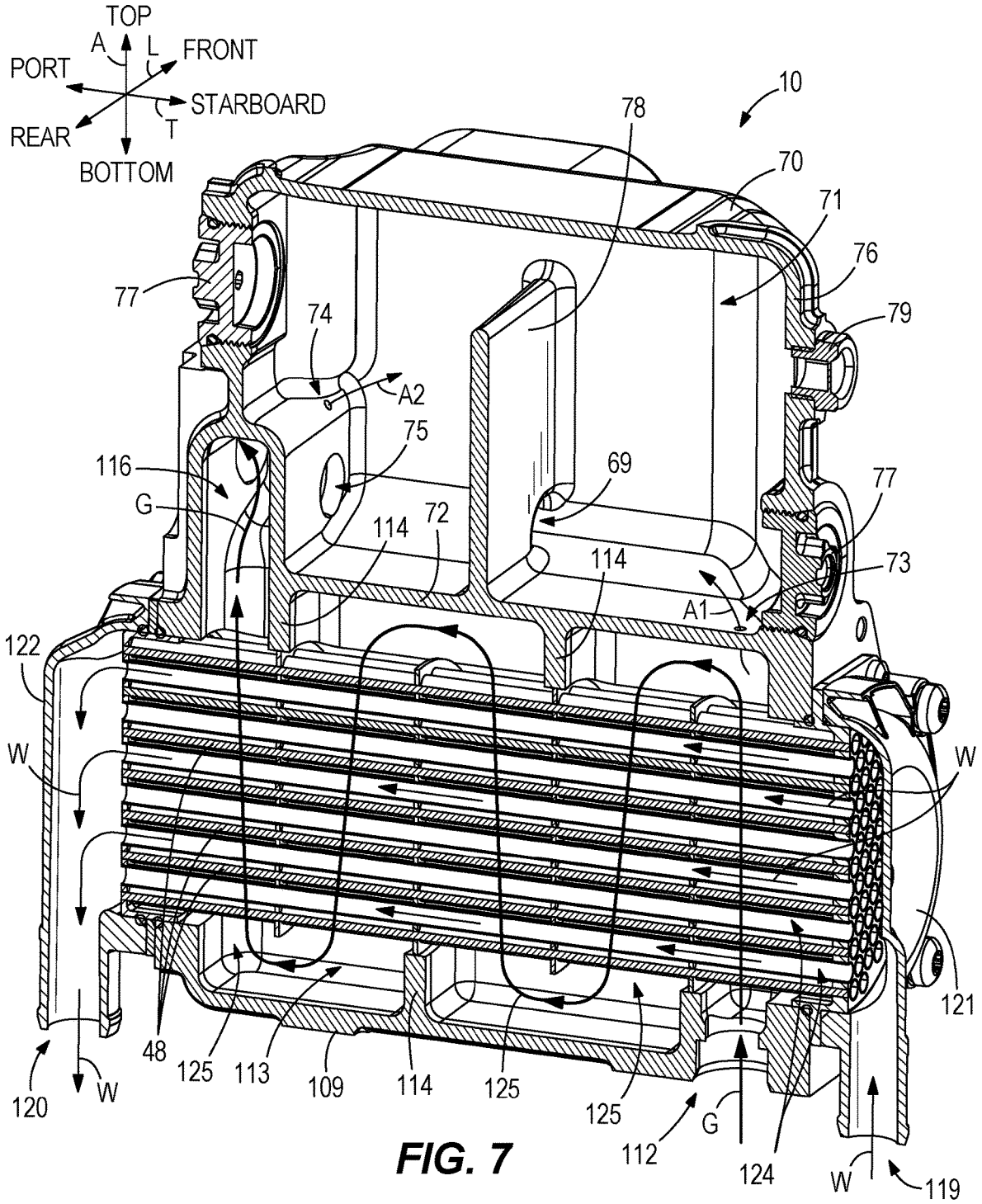
FIG. 7 is a cross-sectional view along line 7-7 on FIG. 5.

For example, air collecting in the chamber 113 during operation of the second cooling system 60 passes through the bleed hole 73 into the reservoir (see arrow A1 on FIG. 7). In addition, the wall 72 further defines one or more air bleed holes 74 configured to bleed air from the outlet passageway 116 to the reservoir 70. For example, air collecting in the outlet passageway 116 passes through the bleed hole 74 into the reservoir 70 (see arrow A2 on FIG. 7). The air bleed holes 73, 74 exemplarily function to permit flow of the second cooling fluid into the reservoir 70 when the second cooling system 60 is filled with the second cooling fluid. Note that in certain examples, the reservoir 70 is located relative to the heat exchanger 109 such that the second cooling fluid in the reservoir 70 flows or drains by gravity to the heat exchanger 109 (for example via the air bleed holes 73, 74) and air that accumulates in the heat exchanger 109 tends to bleed to the reservoir 70 (for example via the air bleed holes 73, 74). In certain examples, the heat exchanger 109 generally laterally extends between the end caps 121, 122 such that any air within the heat exchanger 109 naturally rises axially upward thereby avoiding serviceability problems with conventional vertically oriented heat exchangers.

An opening 75 in the wall 72 permits passage of the second cooling fluid from the reservoir 70 into the outlet passageway 116 in the event additional amounts of the second cooling fluid are necessary to maintain adequate amounts of the second cooling fluid in the components of the second cooling system 60 and the heat exchanger 109. For example, if an amount of the second cooling fluid inadvertently leaks from the second cooling system 60, additional amounts of the second cooling fluid automatically flow from the reservoir 70 through the opening 75 into the outlet passageway 116 and the second cooling circuit. Similarly, the opening permits passage of the second cooling fluid from the outlet passageway 116 to the reservoir 70. For example, if one of the conduits is pinched (e.g., conduits 86, 87, 89, 90, 91 have a temporarily reduced internal capacity than normal), an amount of the second cooling fluid automatically flows from the outlet passageway 116 through the opening 75 into the reservoir 70.

The reservoir 70 has an exterior wall 76 which further defines the interior space 71. One or more plugs 77 are coupled to the wall 76 to thereby fluidly seal holes (not depicted) that are defined during the manufacturing process of the reservoir 70.

A sight window 79 in the wall 76 is configured to visually checking the level of the second cooling fluid in the reservoir 70. One or more baffles 78 in the interior space 71 are coupled to at least one of the walls 72, 76. The baffles 78 are configured to prevent 'sloshing' of the second cooling fluid in the reservoir and slow down the flow rate of the second cooling fluid through and/or out of the reservoir to prevent air from moving with the second cooling fluid and allow the air to move toward the top of the reservoir 70. One or more cutouts 69 in the baffle 78 permit flow of the second cooling fluid there through. Additionally, the baffles 78 are configured to provide a reference point for use during the visually checking the level of the second cooling fluid in the reservoir 70 when utilizing the sight window 79.

The reservoir 70 includes a pressure release cap 63 configured to vent air pressure from the interior space 71 of the reservoir 70. For example, the pressure of the air in the reservoir 70 may increase as the temperature of the second cooling fluid increases and/or as air enters the reservoir 70 from the heat exchanger 109 or the first inlet conduit 86 (FIG. 3). When the pressure of the air exceeds a predetermined maximum pressure, the pressure release cap 63 opens and release the pressure. Once the air pressure is at or below the predetermined maximum pressure, the pressure release cap 63 closes. The pressure release cap 63 can also be removed during filling operations of the reservoir 70 with the second cooling fluid.

Figure 8:
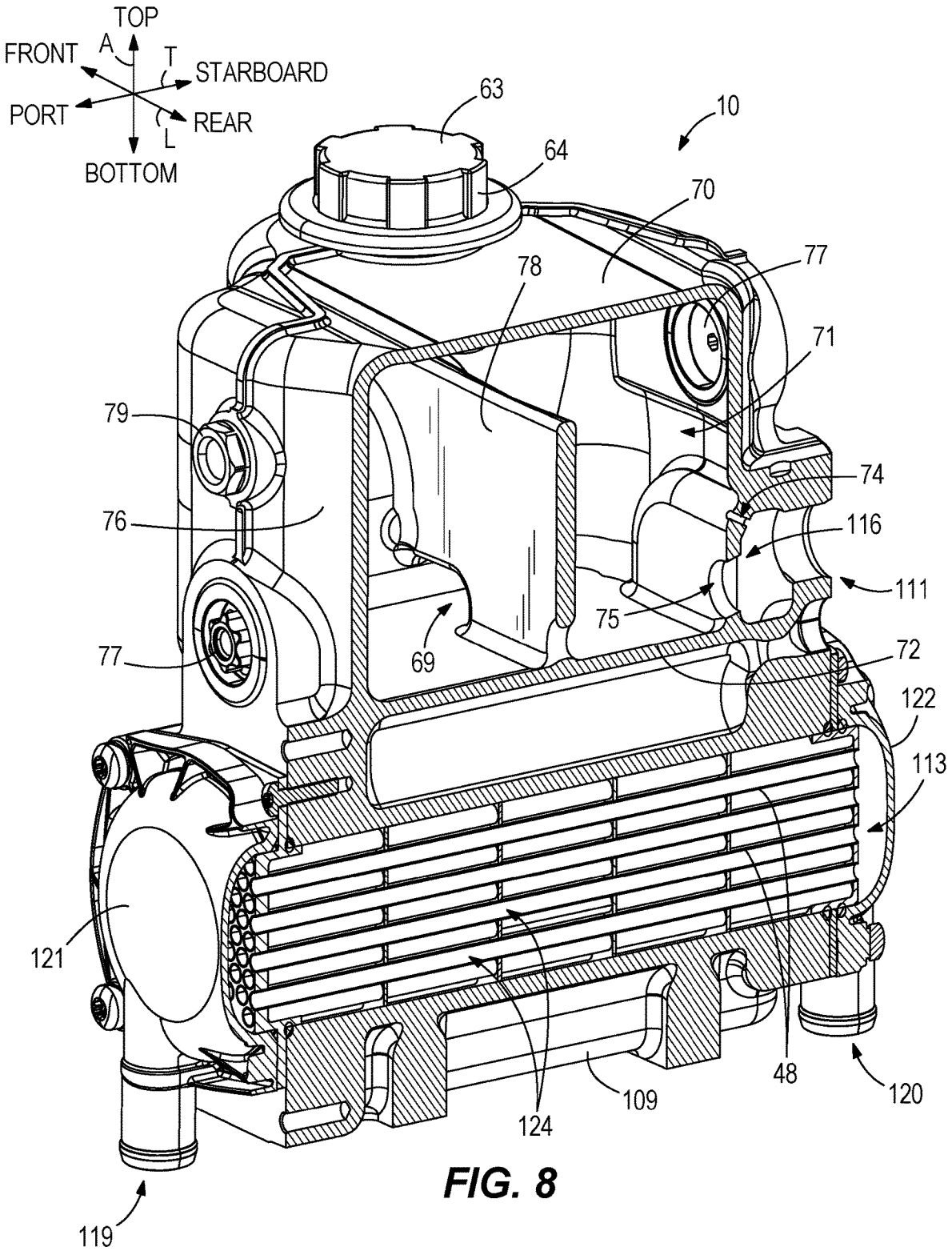
FIG. 8 is a cross-sectional view along line 8-8 on FIG. 5.
Figure 9:
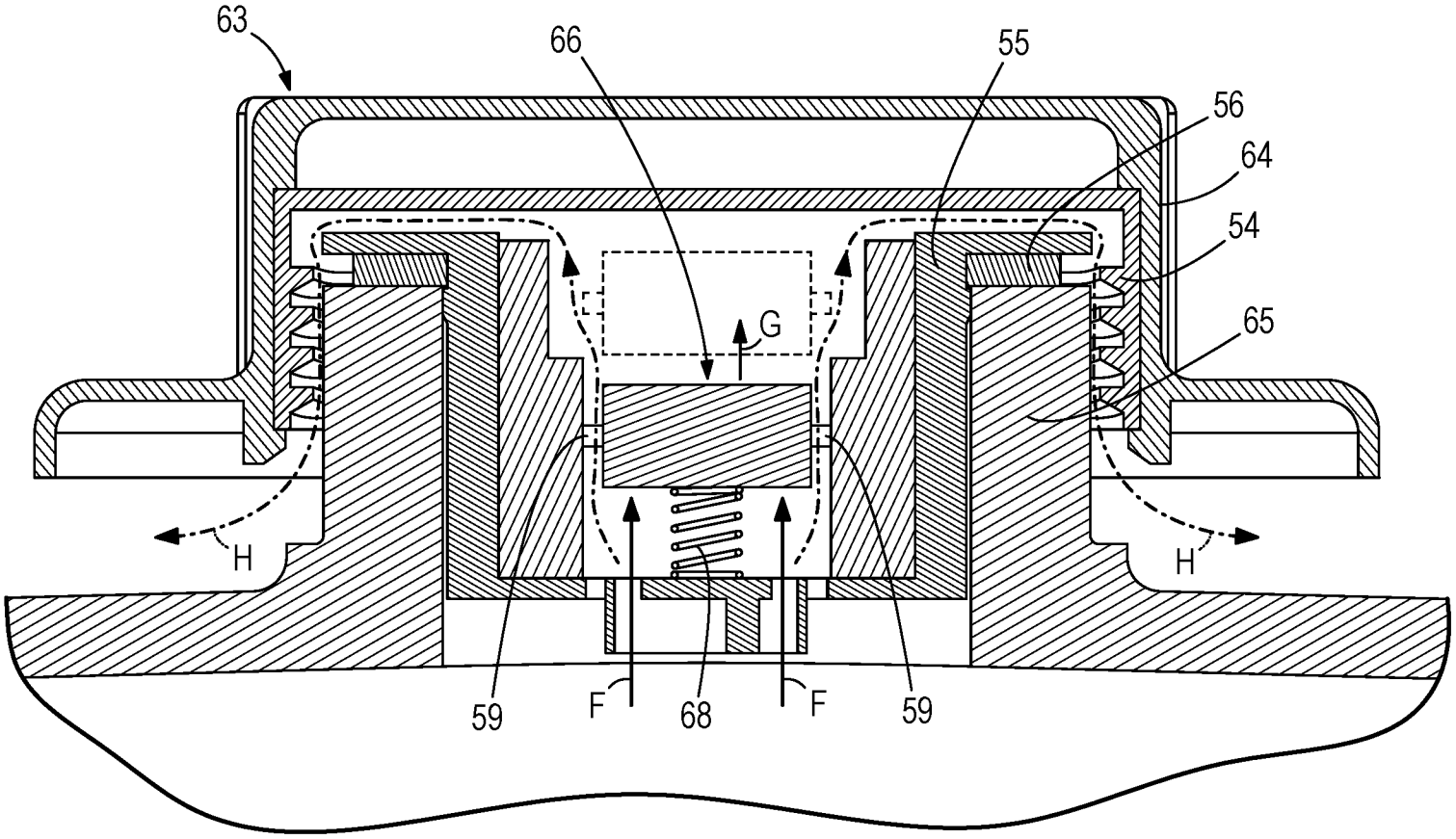
FIG. 9 is a cross-sectional view along line 9-9 on FIG. 5.

FIG. 9 depicts an example pressure release cap 63 in greater detail. The pressure release cap 63 includes an cap cover 64 coupled to an insert assembly 54 that engages a spout 65 of the reservoir 70 (FIG. 8). The insert assembly 54 has an insert 55 and a vent device 66 with a perimeter seal 59. Note that another seal 56 (such as an O-ring) is between the insert 55 and the spout 65. The insert assembly 54 further includes a spring 68 that biases the vent device 66 toward a first position (as depicted on FIG. 9) in which the vent device 66 prevents the flow of air from the reservoir 70 through the pressure release cap 63. When the pressure in the reservoir 70 acting on the vent device 66 (see example arrows F) is greater than an opposing spring force applied by the spring 68 to the vent device 66, the vent device 66 moves (see arrow G on FIG. 9) into a second position (see dashed lines schematically depicting the vent device 66 in the second position) such that air passes through the pressure release cap 63 to the atmosphere (see dash-dot paths H). As the air vents and the pressure in the reservoir 70 decreases, the spring 68 pulls the vent device 66 back to the first position thereby rescaling the reservoir 70.

Figure 10:
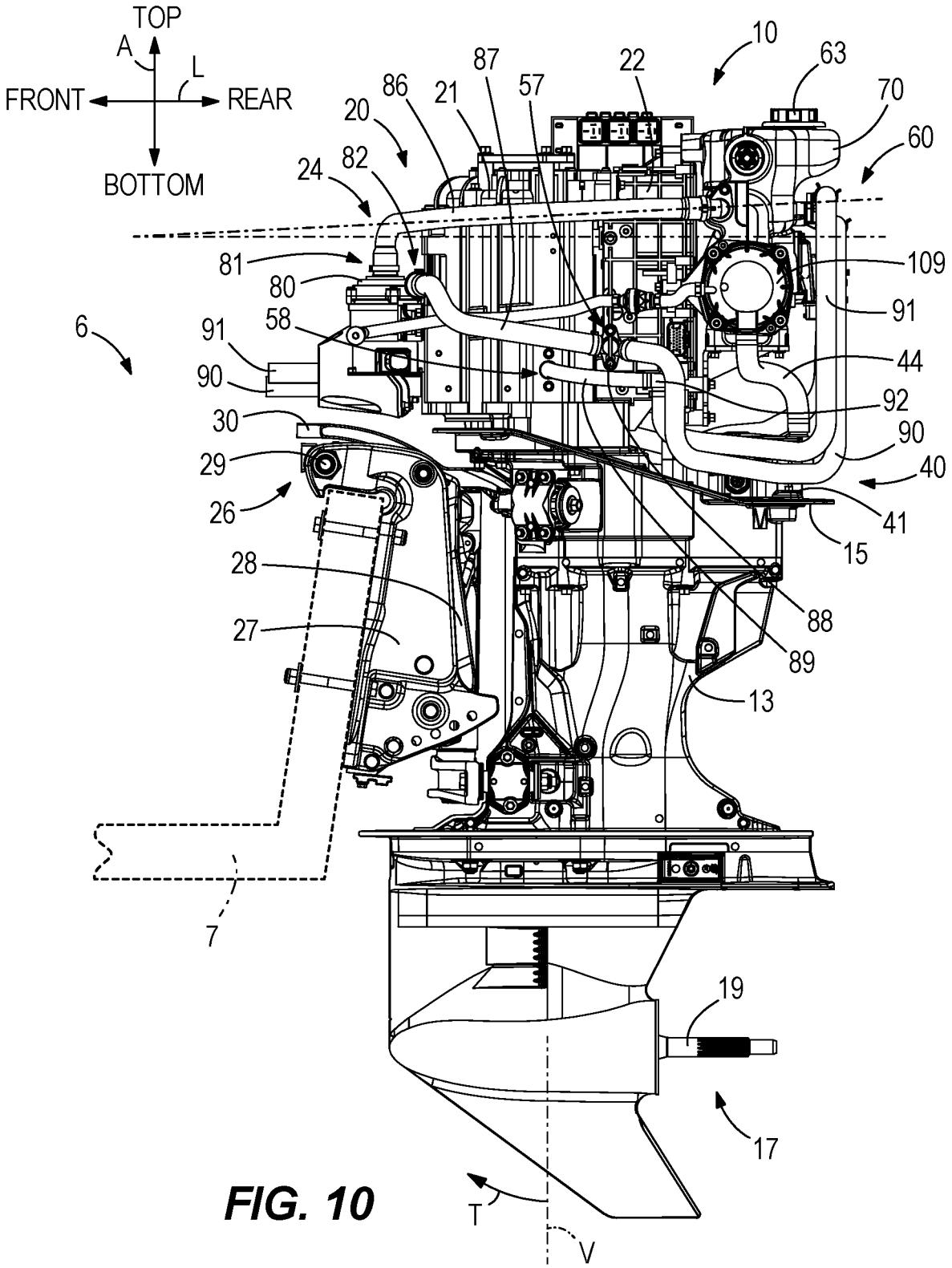
FIG. 10 is a side view of the marine drive of FIG. 1 in a first trim position.
Figure 11:
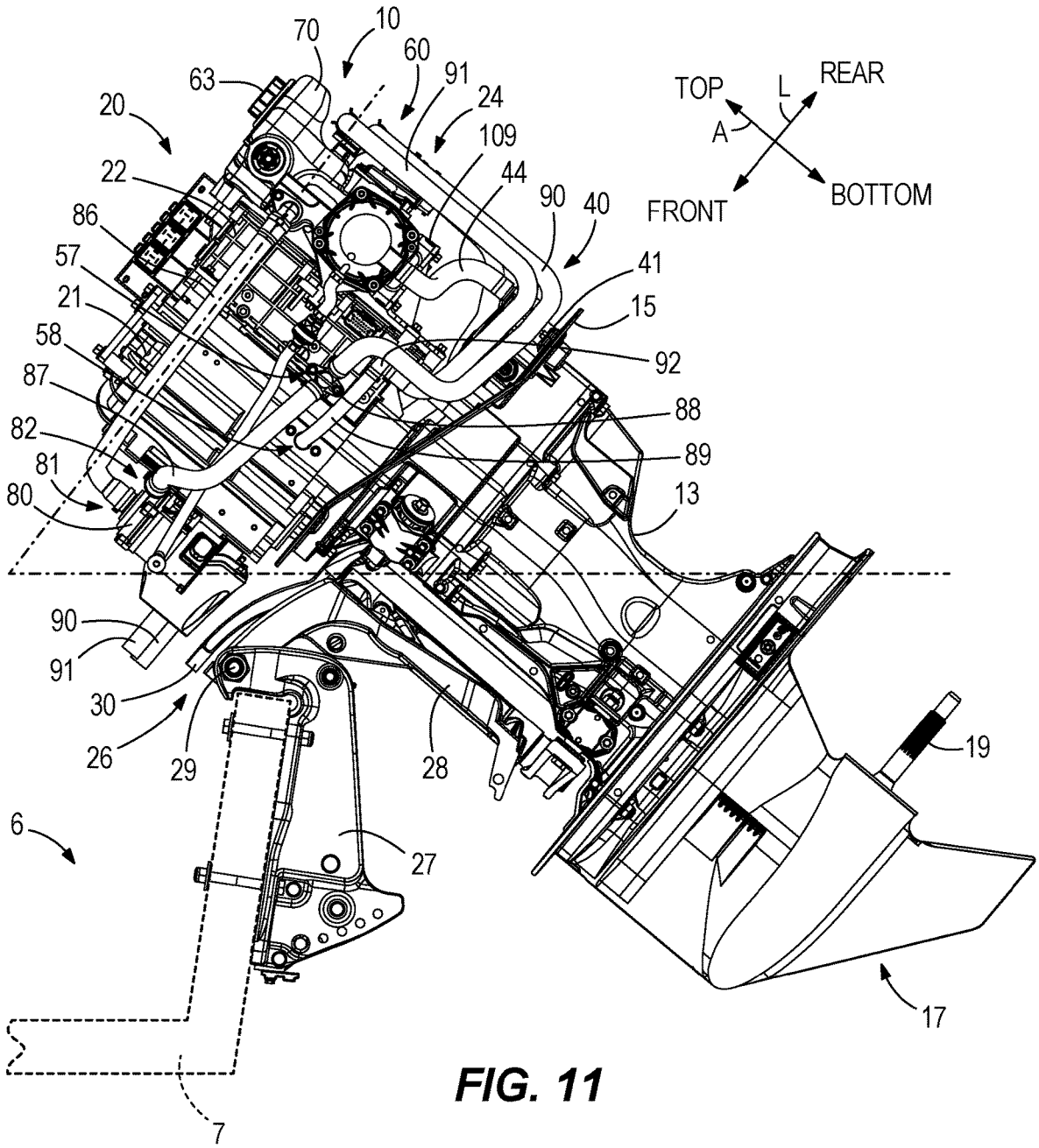
FIG. 11 is a side view of the marine drive of FIG. 1 in a second trim position.

Referring now to FIGS. 10-11, the example marine drive 10 is depicted in a first trim position (FIG. 10) and a second trim position (FIG. 11). The marine drive 10 is trimmable through a range of trim positions, such as the first trim position and the second trim position, by actuation of the one or more trim actuators (not depicted; e.g., hydraulic cylinders). Note that the first trim position (FIG. 10) is a vertical position in which the axial direction of the marine drive 10 is generally vertical and the second trim position (FIG. 11) is a trimmed-up position in which the axial direction is transverse to a horizontal axis perpendicular to the vertical position and the propulsor 17 is orientated away from the transom 7. Further note that the marine drive 10 can be trimmable into a tucked position relative to the vertical position in which the propulsor 17 is oriented toward the transom 7. In certain examples, the marine drive 10 can be 'tucked' into a tucked position in which the marine drive 10 is up to a maximum of 7.0 degrees pivoted from the vertical axis (exemplarily depicted with dashed vertical axis V and arrow T illustrating pivoting the propulsor toward the marine vessel 6).

The present inventors have recognized that the marine drive 10 of the present disclosure has unique advantages over conventional marine drives by locating the components of the marine drive 10 relative to each other to avoid common disadvantages associated with conventional cooling systems for marine drives. For example, the present inventors recognized that air may collect in conventional cooling systems and the accumulation of air could have negative effects on the heat exchangers and/or cooling systems such as decreased system efficiency and/or effectiveness and/or damage to components. Air may enter or be in the cooling system during the initial filling of the system with the second cooling fluid. As such, there is a desire in the industry to reduce or eliminate air in the cooling system, and accordingly, the present inventors developed the marine drives 10 of the present disclosure that advantageously allow any air in the second cooling system 60 to pass into the reservoir 70 where it can be stored or released to the atmosphere. The present inventors also developed the second cooling system 60 and the location of the components thereof so that the fluid head on the second pump 80 is maintained regardless of the position (tilt/trim/steer) of the marine drive 10 to prevent the second pump 80 from running dry and/or to maintain air removed from the second cooling system 60.

The second pump 80 is also located longitudinally forwardly of the reservoir 70 and the electric motor 21 and axially below the reservoir 70. In this position, the second cooling system 60 and/or the second pump 80 is configured such that air that collects at the second pump 80 tends to move axially upwardly and rearwardly from the second pump 80 to the reservoir 70. The air moves due to force of gravity and/or can be affected by the material properties (e.g., density) between the air and the second cooling fluid. In addition, locating the second pump 80 longitudinally forwardly of the reservoir 70 and the electric motor 21 to avoid being negatively affected by the movement of the marine drive 10 (e.g., trimming of the marine drive 10). Further, locating the second pump 80 longitudinally forward on the marine drive 10 advantageously removes space occupying components from the rear of the marine drive 10 (thereby providing more space to service components at the rear of the marine drive 10 such as the first pump 41), moves weight forward on the marine drive, moves weight toward the trim axis 29, and/or moves packaged items forward, maintains better fluid head of the second cooling fluid on the second pump 80, and/or permits for a single point lifting eye which gives more room for electrical component integration and service points.

The first inlet conduit 86 connecting the second pump 80 and the reservoir 70 is designed to advantageously to cause air therein or in the second pump to move toward the reservoir 70. Specifically, the first inlet conduit 86 is sloped axially downwardly in a direction from the reservoir 70 to the second pump 80 to increase the tendency of any air in the second pump 80 and/or the first inlet conduit 86 to move toward the reservoir 70. FIGS. 10-11 illustratively include an example horizonal axis (dash-dot line H) representing an example horizontal plane and a conduit centerline (dash-dot line C), and thus, it is noted that the first inlet conduit 86 is sloped axially downwardly from the reservoir 70 to the second pump 80 throughout the range of trim positions in which the marine drive 10 can be located. For example, the first inlet conduit 86 remains in a sloped axially downwardly orientation in the positions of the marine drive 10 including the vertical position (see FIG. 10), the tucked position, and the trimmed-up position (see FIG. 11).

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a first cooling system comprising a first pump configured to circulate the first cooling fluid through the outboard motor and a second cooling system comprising a reservoir configured to contain a second cooling fluid and a second pump configured to pump the second cooling fluid to at least one component of the outboard motor. A heat exchanger is configured to exchange heat between the first cooling fluid and the second cooling fluid to cool the at least one component of the outboard motor. The second pump is located longitudinally forwardly of the reservoir and axially below the reservoir.

In certain embodiments, the second cooling system is configured such that any air that collects in the second pump tends to move upwardly and rearwardly from the second pump to the reservoir. In certain embodiments, an inlet conduit is configured to supply the second cooling fluid to the second pump, and wherein the inlet conduit is sloped axially downwardly from the reservoir to the second pump. In certain embodiments, a transom bracket is configured to couple the outboard motor to a marine vessel so as to facilitate trimming of the outboard motor through a range of trim positions and an inlet conduit is configured to supply the second cooling fluid from the reservoir to the second pump. The inlet conduit is sloped axially downwardly from the reservoir to the second pump throughout the range of trim positions. In certain embodiments, the range of trim positions comprises a vertical position, a tucked position relative to the vertical position, and a trimmed-up position relative to the vertical position, and wherein the inlet conduit is sloped axially downwardly in each of the vertical position, the tucked position, and the trimmed-up position. In certain embodiments, the second pump is located longitudinally between the transom bracket and the reservoir. In certain embodiments, the outboard motor has a top cowl and a lower cowl, and wherein the second pump is accessible for servicing from above the outboard motor via opening or removal of the top cowl. In certain embodiments, the outboard motor has a top cowl and a lower cowl, and wherein the first pump is accessible for servicing from above the outboard motor via opening or removal of the top cowl. In certain embodiments, the first pump is located longitudinally rearwardly of and axially below the reservoir. In certain embodiments, the second pump comprises a pump inlet configured for receiving the second cooling fluid from the reservoir, and wherein the pump inlet is oriented upwardly in the axial direction. In certain embodiments, the first pump is located axially lower than the second pump. In certain embodiments, the second pump is located closer to the port side than the starboard side.

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a powerhead and a top cowl enclosing the powerhead in a powerhead compartment. The top cowl can be opened or removed from the outboard motor to provide access to the powerhead from above the outboard motor. A first cooling system comprises a first pump configured to circulate the first cooling fluid through the outboard motor, and a second cooling system comprises a reservoir configured to contain a second cooling fluid and a second pump configured to pump the second cooling fluid to cool at least one component of the outboard motor. A heat exchanger is configured to exchange heat between the first cooling fluid and the second cooling fluid to cool the at least one component of the outboard motor. The second pump and first pump are accessible from above the outboard motor upon opening and/or removal of the top cowl.

In certain embodiments, the powerhead comprises an electric motor, and wherein the second pump is located longitudinally forwardly of the electric motor and the reservoir is located axially higher than the second pump. In certain embodiments, the first pump is located longitudinally rearwardly of the electric motor. In certain embodiments, an adapter plate is below the powerhead compartment, and wherein the first pump is located on or above the adapter plate and below the second pump. In certain embodiments, the heat exchanger is located in the powerhead compartment. In certain embodiments, the second cooling system is configured such that any air that collects in the second pump tends to move upwardly and rearwardly from the second pump to the reservoir. In certain embodiments, an inlet conduit is configured to supply the second cooling fluid from the reservoir to the second pump, and wherein the inlet conduit is sloped axially downwardly from the reservoir to the second pump. In certain embodiments, a transom bracket is configured to couple the outboard motor to a marine vessel so as to facilitate trimming of the outboard motor through a range of trim positions and an inlet conduit is configured to supply the second cooling fluid from the reservoir to the second pump. The inlet conduit is sloped axially downwardly from the reservoir to the second pump throughout the range of trim positions.

In independent examples, an apparatus on a marine drive having a first cooling system configured to convey a first cooling fluid through the marine drive and a second cooling system configured to convey a second cooling fluid through the marine drive comprises a reservoir configured to store the second cooling fluid and a heat exchanger configured to exchange heat between the first cooling fluid and the second cooling fluid. The reservoir and the heat exchanger are integrated as a single part.

In certain embodiments, the single part is a monolithic body comprising the reservoir and the heat exchanger. In certain embodiments, the single part is a cast metal part. In certain embodiments, the apparatus comprises one or more first passages through which the first cooling fluid is conveyed from a first inlet to a first outlet of the heat exchanger and one or more second passages through which the second cooling fluid is conveyed from a second inlet to a second outlet of the heat exchanger. In certain embodiments, the apparatus comprises serviceable end caps defining the second inlet and the second outlet. In certain embodiments, the apparatus comprises at least one air bleed hole configured to bleed air from one of the second passages to the reservoir. In certain embodiments, the apparatus comprises a wall separating the reservoir and the heat exchanger, and wherein the wall comprises an air bleed hole configured to bleed air from the heat exchanger to the reservoir. In certain embodiments, the air bleed hole facilitates filling of the heat exchanger with the second cooling fluid. In certain embodiments, the apparatus comprises a sight window configured for visually checking a level of the second cooling fluid in the reservoir. In certain embodiments, the apparatus comprises a baffle in the reservoir, and the baffle providing a reference point for use during the visually checking. In certain embodiments, the single part extends from a first side to a second side in a lateral direction and from top to bottom in an axial direction which is perpendicular to the axial direction, and wherein the reservoir is located axially higher than the heat exchanger. In certain embodiments, the reservoir is located relative to the heat exchanger such that the second cooling fluid in the reservoir drains by gravity to the heat exchanger and air that accumulates in the heat exchanger tends to bleed to the reservoir.

In independent examples, an outboard motor extends from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction. The outboard motor comprises a first cooling system configured to convey a first cooling fluid through the outboard motor and a second cooling system configured to convey a second cooling fluid through the outboard motor. An apparatus for the second cooling system comprising a reservoir configured to store the second cooling fluid, and a heat exchanger configured to exchange heat between the first cooling fluid and the second cooling fluid. The reservoir and the heat exchanger are integrated as a single part.

In certain embodiments, the reservoir is located axially higher than the heat exchanger such that the second cooling fluid in the reservoir drains by gravity to the heat exchanger and air that accumulates in the heat exchanger tends to bleed to the reservoir. In certain embodiments, the apparatus comprises one or more first passages through which the first cooling fluid is conveyed from a first inlet to a first outlet of the heat exchanger and one or more second passages through which the second cooling fluid is conveyed from a second inlet to a second outlet of the heat exchanger. In certain embodiments, the outboard motor is trimmable through a range of trim positions relative to a marine vessel, and wherein the apparatus is configured so that the first outlet and the second outlet remain below a level of the second cooling fluid in the reservoir throughout the range of trim positions. In certain embodiments, the apparatus configured so that the first inlet and the second inlet remain below the level of the second cooling fluid in the reservoir throughout the range of trim positions. In certain embodiments, the reservoir is located relative to the heat exchanger so that the second cooling fluid in the reservoir drains by gravity to the heat exchanger and such that air that accumulates in the heat exchanger tends to bleed to the reservoir. In certain embodiments, the single part is a monolithic body comprising the reservoir and the heat exchanger. In certain embodiments, the single part is a cast metal part.

This written description uses examples to disclose the invention and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An outboard motor extending from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction, the outboard motor comprising:

a first cooling system comprising a first pump configured to circulate a first cooling fluid through the outboard motor;

a second cooling system comprising a reservoir configured to contain a second cooling fluid and a second pump configured to pump the second cooling fluid to at least one component of the outboard motor; and a heat exchanger configured to exchange heat between the first cooling fluid and the second cooling fluid to cool the at least one component of the outboard motor;

wherein the second pump is located longitudinally forwardly of the reservoir and axially below the reservoir.

2. The outboard motor according to claim 1, wherein the second cooling system is configured such that any air that collects in the second pump tends to move upwardly and rearwardly from the second pump to the reservoir.

3. The outboard motor according to claim 1, further comprising an inlet conduit configured to supply the second cooling fluid to the second pump, and wherein the inlet conduit is sloped axially downwardly from the reservoir to the second pump.

4. The outboard motor according to claim 1, further comprising a transom bracket configured to couple the outboard motor to a marine vessel so as to facilitate trimming of the outboard motor through a range of trim positions; and an inlet conduit configured to supply the second cooling fluid from the reservoir to the second pump;

wherein the inlet conduit is sloped axially downwardly from the reservoir to the second pump throughout the range of trim positions.

5. The outboard motor according to claim 4, wherein the range of trim positions comprises a vertical position, a tucked position relative to the vertical position, and a trimmed-up position relative to the vertical position, and wherein the inlet conduit is sloped axially downwardly in each of the vertical position, the tucked position, and the trimmed-up position.

6. The outboard motor according to claim 5, wherein the second pump is located longitudinally between the transom bracket and the reservoir.

7. The outboard motor according to claim 1, further comprising a top cowl and a lower cowl, wherein the second pump is accessible for servicing from above the outboard motor via opening or removal of the top cowl.

8. The outboard motor according to claim 1, further comprising a top cowl and a lower cowl;

and wherein the first pump is accessible for servicing from above the outboard motor via opening or removal of the top cowl.

9. The outboard motor according to claim 1, wherein the first pump is located longitudinally rearwardly of and axially below the reservoir.

10. The outboard motor according to claim 1, wherein the second pump comprises a pump inlet configured for receiving the second cooling fluid from the reservoir, and wherein the pump inlet is oriented upwardly in the axial direction.

11. The outboard motor according to claim 1, wherein the first pump is located axially lower than the second pump.

12. The outboard motor according to claim 1, wherein the second pump is located closer to the port side than the starboard side.

13. An outboard motor extending from a top to a bottom in an axial direction, from a port side to a starboard side in a lateral direction which is perpendicular to the axial direction, and from a front side to a rear side in a longitudinal direction which is perpendicular to the axial direction and perpendicular to the lateral direction, the outboard motor comprising:

a powerhead;

a top cowl enclosing the powerhead in a powerhead compartment, wherein the top cowl can be opened or removed from the outboard motor to provide access to the powerhead from above the outboard motor;

a first cooling system comprising a first pump configured to circulate a first cooling fluid through the outboard motor;

a second cooling system comprising a reservoir configured to contain a second cooling fluid and a second pump configured to pump the second cooling fluid to cool at least one component of the outboard motor; and a heat exchanger configured to exchange heat between the first cooling fluid and the second cooling fluid to cool the at least one component of the outboard motor;

wherein the first pump and the second pump are accessible from above the outboard motor upon opening and/or removal of the top cowl.

14. The outboard motor according to claim 13, wherein the powerhead comprises an electric motor, and wherein the second pump is located longitudinally forwardly of the electric motor and the reservoir is located axially higher than the second pump.

15. The outboard motor according to claim 14, wherein the first pump is located longitudinally rearwardly of the electric motor.

16. The outboard motor according to claim 13, further comprising an adapter plate below the powerhead compartment, and wherein the first pump is located on or above the adapter plate and below the second pump.

17. The outboard motor according to claim 13, wherein the heat exchanger is located in the powerhead compartment.

18. The outboard motor according to claim 13, wherein the second cooling system is configured such that any air that collects in the second pump tends to move upwardly and rearwardly from the second pump to the reservoir.

19. The outboard motor according to claim 13, further comprising an inlet conduit configured to supply the second cooling fluid from the reservoir to the second pump, and wherein the inlet conduit is sloped axially downwardly from the reservoir to the second pump.

20. The outboard motor according to claim 13, further comprising a transom bracket configured to couple the outboard motor to a marine vessel so as to facilitate trimming of the outboard motor through a range of trim positions; and an inlet conduit configured to supply the second cooling fluid from the reservoir to the second pump;

wherein the inlet conduit is sloped axially downwardly from the reservoir to the second pump throughout the range of trim positions.

* * * * *